US008995852B2

(12) United States Patent
Suzuki

(10) Patent No.: US 8,995,852 B2
(45) Date of Patent: Mar. 31, 2015

(54) IMAGE FORMING DEVICE DETERMINING WHETHER OR NOT REPLACEMENT OF CARTRIDGE IS NEEDED

(71) Applicant: Satoru Suzuki, Kasugai (JP)

(72) Inventor: Satoru Suzuki, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/199,276

(22) Filed: Mar. 6, 2014

(65) Prior Publication Data

US 2014/0255048 A1 Sep. 11, 2014

(30) Foreign Application Priority Data

Mar. 7, 2013 (JP) ..... 2013-045643

(51) Int. Cl.

| | |
|---|---|
| ***G03G 15/08*** | (2006.01) |
| ***G03G 15/00*** | (2006.01) |
| ***G03G 15/04*** | (2006.01) |
| *G03G 21/18* | (2006.01) |

(52) U.S. Cl.

CPC ..... *G03G 15/0856* (2013.01); *G03G 15/0862* (2013.01); *G03G 21/1875* (2013.01); *G03G 15/0831* (2013.01)

USPC ..... 399/27; 399/12; 399/119

(58) Field of Classification Search

CPC ..... G03G 15/0862; G03G 15/0831; G03G 21/1875

USPC ..... 399/27, 119, 12

See application file for complete search history.

(56) References Cited

U.S. PATENT DOCUMENTS

| | | | | |
|---|---|---|---|---|
| 6,330,402 | B1 * | 12/2001 | Sakurai et al. | 399/12 |
| 6,456,802 | B1 | 9/2002 | Phillips | |
| 6,775,487 | B2 | 8/2004 | Kakeshita | |
| 2002/0037173 | A1 | 3/2002 | Kakeshita | |
| 2002/0141765 | A1 | 10/2002 | Phillips | |
| 2009/0010659 | A1 * | 1/2009 | Watanabe | 399/27 |
| 2010/0202798 | A1 * | 8/2010 | Suzuki et al. | 399/118 |
| 2012/0230730 | A1 * | 9/2012 | Ogino | 399/119 |

FOREIGN PATENT DOCUMENTS

| | | | |
|---|---|---|---|
| JP | H02-39178 | A | 2/1990 |
| JP | 2002-062723 | A | 2/2002 |
| JP | 2002-372848 | A | 12/2002 |
| JP | 2004-045861 | A | 2/2004 |

(Continued)

*Primary Examiner* — David Gray
*Assistant Examiner* — Tyler Hardman
(74) *Attorney, Agent, or Firm* — Banner & Witcoff, Ltd.

(57) ABSTRACT

Either a first developer cartridge or a second developer cartridge is attachable to an image forming device. The second developer cartridge has capacity for accommodating developer larger than capacity for accommodating developer of the first developer cartridge. The control device determines whether the attached cartridge is the first developer cartridge or the second developer cartridge; determines that the replacement of the attached cartridge is needed upon comparison of a consumed amount of developer based on the image data that is inputted with a first threshold value when the first developer cartridge is attached; and determines that replacement of the attached cartridge is needed upon comparison of a detection value with a second threshold value when the second developer cartridge is attached. The detection value is obtained based on the detection information outputted by the detection device.

7 Claims, 6 Drawing Sheets

(56) References Cited

FOREIGN PATENT DOCUMENTS

| | | | |
|---|---|---|---|
| JP | 2004-347931 | A | 12/2004 |
| JP | 2005-114933 | A | 4/2005 |
| JP | 2005-208077 | A | 8/2005 |
| JP | 2005-300685 | A | 10/2005 |
| JP | 2011-203493 | A | 10/2011 |

* cited by examiner

IMAGE FORMING DEVICE DETERMINING WHETHER OR NOT REPLACEMENT OF CARTRIDGE IS NEEDED

CROSS REFERENCE TO RELATED APPLICATION

This application claims priority from Japanese Patent Application No. 2013-045643 filed Mar. 7, 2013. The entire content of the priority application is incorporated herein by reference.

TECHNICAL FIELD

The present invention relates to an image forming device and an image forming system.

BACKGROUND

Among conventional image forming devices having replaceable developer cartridges in which developer is stored, a device configured to determine the time to replace the attached developer cartridge is known. For example, an image forming device disclosed in Patent Document 1 (Japan Patent Application Laid-Open Publication No. H02-39178) starts to count the number of dots printed on sheet S right after replacement of the developer cartridge; calculates the total amount of developer consumed based on the number of dots and based on an amount of developer consumed that is required to form one dot; and determines that it is time to replace the developer cartridge if the calculated total amount of developer consumed exceeds a threshold value.

SUMMARY

However, for an image forming device can accommodate and use any one of developer cartridges having different initial accommodated amounts of developer, it may be difficult to appropriately determine the replacement time to replace a developer cartridge having a large initial accommodated amount of developer by using calculated parameters relating to the amounts of developer consumed, such as the number of dots. The reason is that, in the case of the developer cartridge having the large initial amount of developer, an error between the calculated consumed amount of developer and the actual consumed amount of developer tends to become accumulated and larger over time as the actual amount varies depending on print conditions.

In view of the foregoing, it is an object of the invention to provide an image forming device and image forming system that can appropriately determine the replacement time for each of developer cartridges with different initial accommodated amounts of developer.

In order to attain the above and other objects, the invention provides an image forming device including an image forming unit, a holding section, a detection device, and a control device. The image forming unit is configured to form an image on a sheet based on image data. Either a first developer cartridge or a second developer cartridge is attachable to the holding section. Each of the first developer cartridge and the second developer cartridge is configured to accommodate developer therein. The second developer cartridge has capacity for accommodating developer larger than capacity for accommodating developer of the first developer cartridge. The detection device is configured to detect a remaining amount of developer in a developer cartridge attached to the holding section and configured to output detection information. The control device is configured to control the image forming unit to form the image on the sheet when the image data is inputted. The control device is further configured to: determine whether the developer cartridge attached to the holding section is the first developer cartridge or the second developer cartridge; determine that replacement of the developer cartridge attached to the holding section is needed upon comparison of a consumed amount of developer based on the image data that is inputted with a first prescribed threshold value when the developer cartridge attached to the holding section is determined to be the first developer cartridge; and determine that replacement of the developer cartridge attached to the holding section is needed upon comparison of a detection value with a second prescribed threshold value when the developer cartridge attached to the holding section is determined to be the second developer cartridge. The detection value is obtained based on the detection information outputted by the detection device.

According to another aspect, the present invention provides an image forming system including an image forming device, a first developer cartridge and a second developer cartridge. The first developer cartridge is configured to accommodate developer therein. The second developer cartridge is configured to accommodate developer therein. The second developer cartridge has capacity for accommodating developer larger than capacity for accommodating developer of the first developer cartridge. The image forming device includes an image forming unit, a holding section, a detection device, and a control device. The image forming unit is configured to form an image on a sheet based on image data. Either the first developer cartridge or the second developer cartridge is attachable to the holding section. The detection device is configured to detect a remaining amount of developer in a developer cartridge attached to the holding section and configured to output detection information. The control device is configured to control the image forming unit to form the image on the sheet when the image data is inputted. The control device is further configured to: determine whether the developer cartridge attached to the holding section is the first developer cartridge or the second developer cartridge; determine that replacement of the developer cartridge attached to the holding section is needed upon comparison of a consumed amount of developer based on the image data that is inputted with a first prescribed threshold value when the developer cartridge attached to the holding section is determined to be the first developer cartridge; and determine that replacement of the developer cartridge attached to the holding section is needed upon comparison of a detection value with a second prescribed threshold value when the developer cartridge attached to the holding section is determined to be the second developer cartridge. The detection value is obtained based on the detection information outputted by the detection device.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
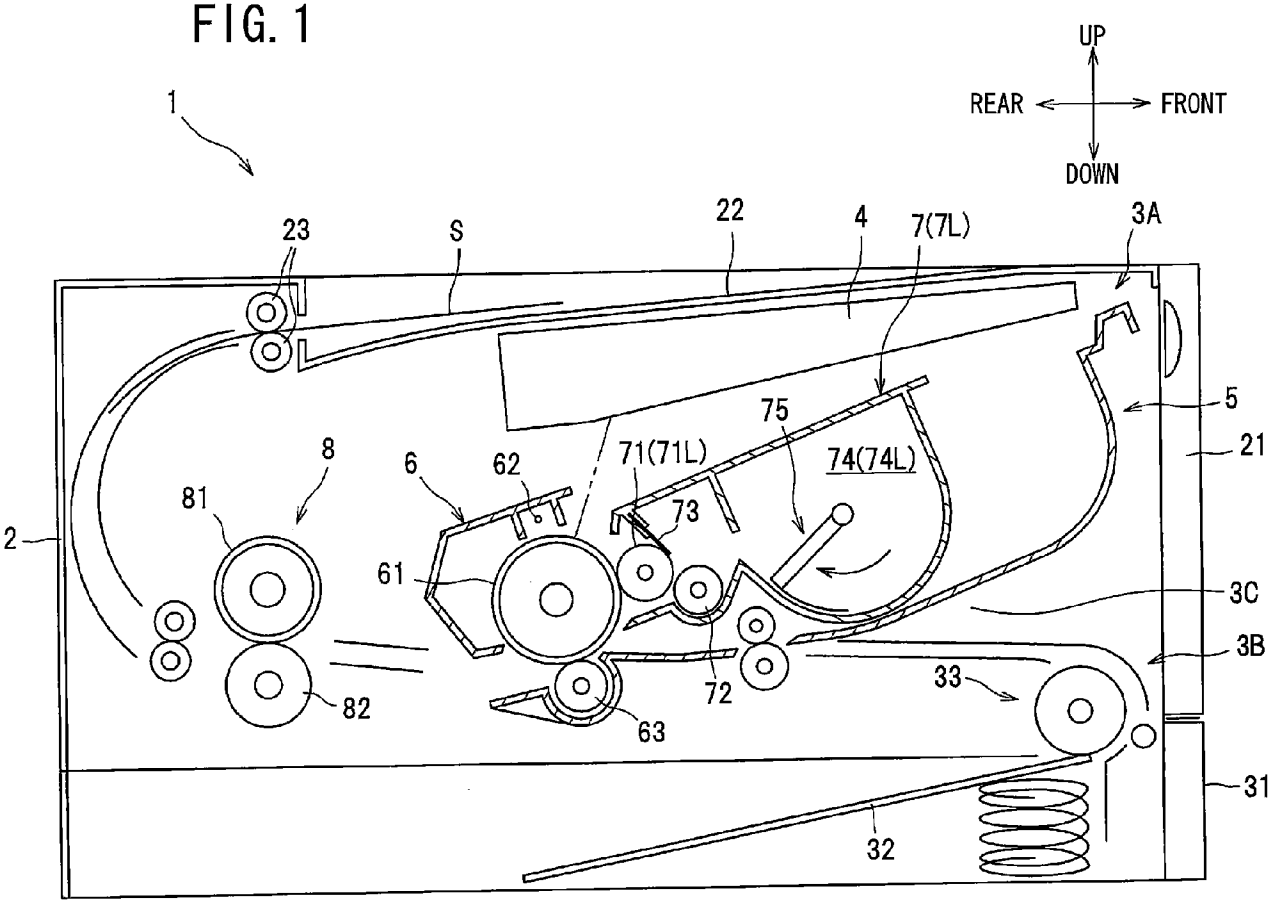
FIG. 1 is a schematic view of an image forming device according to an embodiment of the invention when a developing cartridge of small capacity type is attached to the image forming device.

An embodiment of the present invention will be described in detail with reference to FIGS. 1 to 6. Incidentally, first the general configuration of a laser printer 1 will be described and then, the detailed configuration of an image forming system will be described. In the description below, the directions are defined relative to a user who uses the image forming device. More specifically, the right side of FIG. 1, or the front side of the user, is referred to as a "front" side; the left side of FIG. 1, or the back side of the user, is referred to as a "rear" side; the paper-surface front side of FIG. 1 is referred to as a "left" side, and the paper-surface back side as a "right" side. Moreover, the up-down direction of FIG. 1 is referred to as an "up-down" direction.

<General Configuration of Laser Printer>

As shown in FIG. 1, the laser printer 1 mainly includes the following sections in a casing 2: an image forming unit 3A configured to form an image on a sheet of paper S; and a sheet feeding unit 3B configured to supply the sheet S to the image forming unit 3A.

The sheet feeding unit 3B is provided in a lower portion of the casing 2. The sheet feeding unit 3B includes a sheet feed tray 31 in which paper sheets S are stored, a sheet pressing plate 32, and a sheet feeding mechanism 33. The sheets S stored in the sheet feed tray 31 are lifted up by the sheet pressing plate 32. The sheet feeding mechanism 33 is configured to separate the sheets S one by one, and then the separated sheet S is supplied to a process cartridge 5.

The image forming unit 3A mainly includes an exposure device 4, the process cartridge 5, and a fixing device 8. The process cartridge 5 is configured to transfer a toner image onto a sheet S, and the fixing device 8 is configured to thermally fix the toner image transferred onto the sheet S.

The exposure device 4 is disposed in an upper portion of the casing 2. The exposure device 4 includes a laser light source, a polygon mirror, lenses, and reflective mirrors, which are not shown in the diagrams. The exposure device 4 is configured to expose a peripheral surface of a photosensitive drum 61 (described later) by emitting a laser beam from the laser light source (see chain line) based on image data and rapidly scanning on the peripheral surface of the photosensitive drum 61.

The process cartridge 5 is disposed below the exposure device 4. The process cartridge 5 is attached to the casing 2 and removable from the casing 2 through an opening that is formed when a front cover 21 is opened. The front cover 21 is provided on the casing 2. The process cartridge 5 includes a drum cartridge 6 and a developing cartridge 7. The drum cartridge 6 includes the photosensitive drum 61, a charging unit 62, and a transfer roller 63. The developing cartridge 7 is detachably attached to the drum cartridge 6. The developing cartridge 7 includes a developing roller 71, a supply roller 72, a layer thickness regulating blade 73, an accommodating section 74 configured to accommodate toner therein, and an agitator 75.

The charging unit 62 charges the peripheral surface of the photosensitive drum 61 uniformly. After being uniformly charged, the surface of the photosensitive drum 61 is exposed to the laser beam from the exposure device 4. As a result, an electrostatic latent image is formed on the photosensitive drum 61 based on image data. The toner in the accommodating section 74 is stirred by the agitator 75, and moves toward the supply roller 72. The toner is supplied to the developing roller 71 via the supply roller 72. As the developing roller 71 is rotated, the toner enters between the developing roller 71 and the layer thickness regulating blade 73, and is held on the developing roller 71 as a thin layer of a constant thickness. Then, the toner held on the developing roller 71 is supplied to the photosensitive drum 61. As a result, the electrostatic latent image is visualized, and a toner image is formed on the photosensitive drum 61. After that, the toner image on the photosensitive drum 61 is transferred onto the sheet S when the sheet S fed from the sheet feeding unit 3B passes between the photosensitive drum 61 and the transfer roller 63.

The fixing device 8 is disposed behind the process cartridge 5. The fixing device 8 includes a heating roller 81, and a pressure roller 82 that is so disposed as to face the heating roller 81 to press the heating roller 81. In the fixing device 8, the sheet S to which the toner image has been transferred passes between the heating roller 81 and the pressure roller 82, and the toner image is thermally fixed on the sheet S as a result. The sheet S on which the toner image is thermally fixed is discharged onto a sheet discharge tray 22 by a paper discharge roller 23. The sheet discharge tray 22 is provided in the upper portion of the casing 2.

<Detailed Configuration of Image Forming System>

Figure 2:
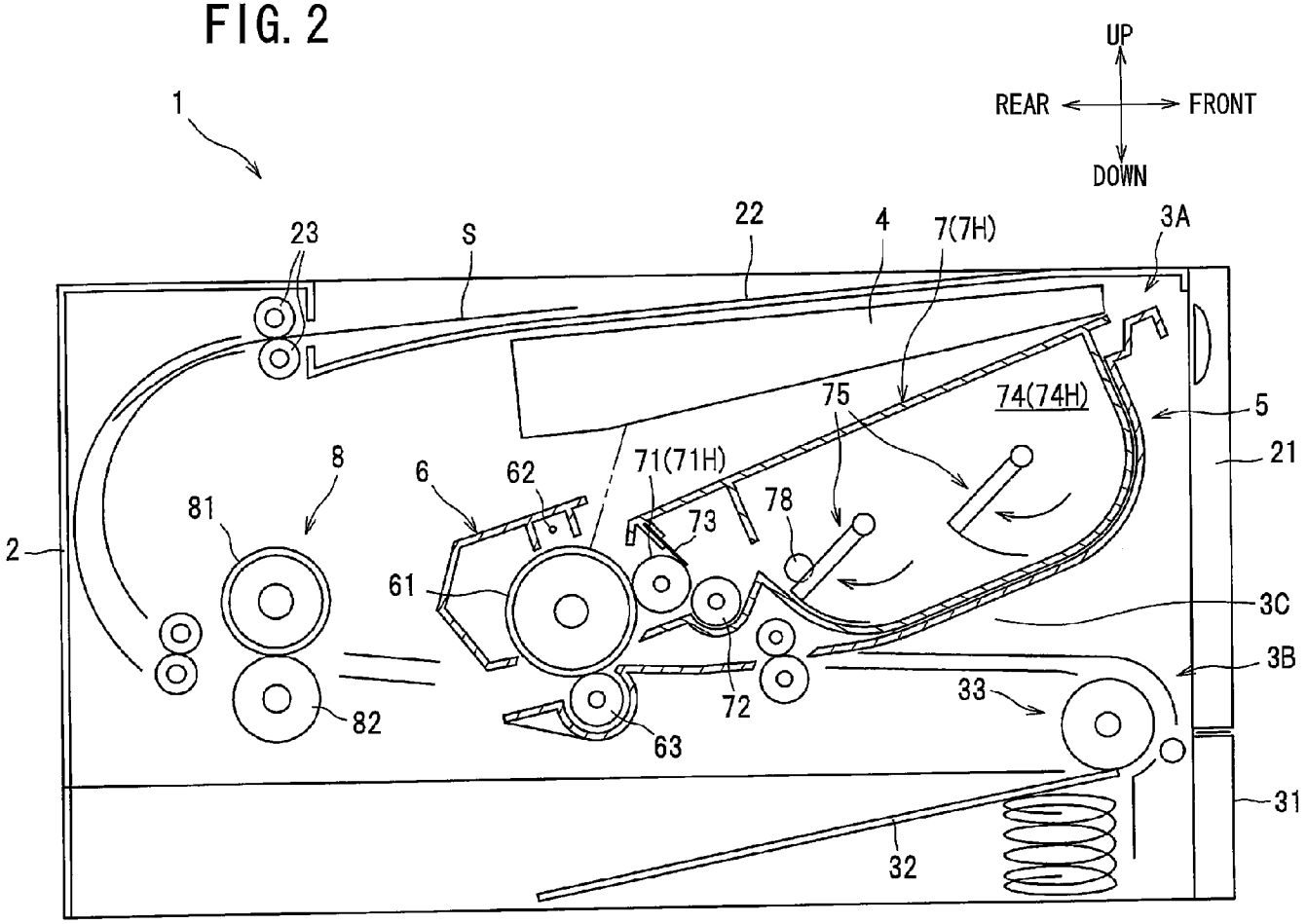
FIG. 2 is a schematic view of the image forming device according to the embodiment when a developing cartridge of large capacity type is attached to the image forming device.

An image forming system includes the laser printer 1; a developing cartridge 7L of a small capacity type shown in FIG. 1; and a developing cartridge 7H of a large capacity type shown in FIG. 2. The laser printer 1 is configured so as to accommodate either the developing cartridges 7L or 7H via the drum cartridge 6.

As shown in FIG. 1, the developing cartridge 7L of the small capacity type includes a developing roller 71L and an accommodating section 74L accommodating the toner therein. As one example, the accommodating section 74L is filled with an amount of toner enough to print 3,000 A4-size paper sheet S at a coverage rate of 5%.

Figure 3:
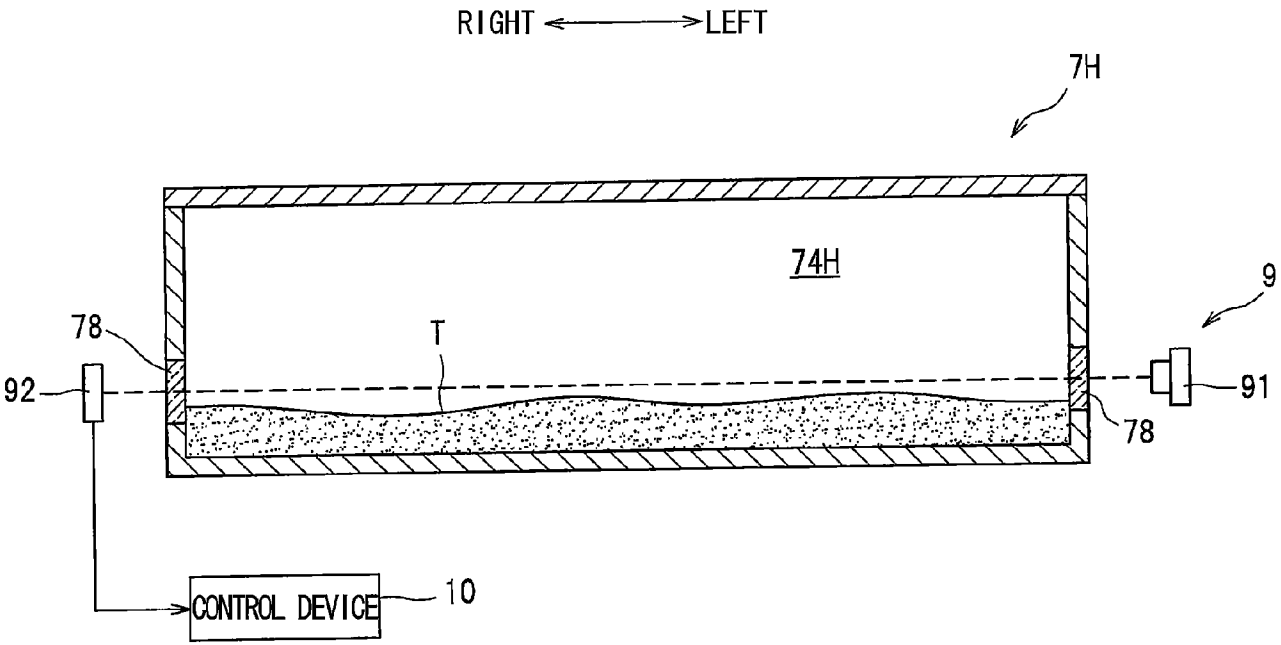
FIG. 3 is an explanatory diagram showing the constructions of a detection device of the image forming device according to the embodiment.

As shown in FIG. 2, the developing cartridge 7H of the large capacity type includes a developing roller 71H and an accommodating section 74H. The accommodating section 74H is so formed as to have a larger capacity than a capacity of the accommodating section 74L (See FIG. 1) of the developing cartridge 7L. Therefore, the accommodating section 74H can accommodate a larger amount of tonner than the accommodating section 74L. As one example, the accommodating section 74H of the developing cartridge 7H is filled with an amount of toner enough to print 12,000 A4-size paper sheet S at a coverage rate of 5%. As shown in FIGS. 2 and 3, in rear portions of left and right walls (reference symbols omitted) that make up the accommodating section 74H, a pair of transparent light transmission portions 78 is so formed as to face each other in the left-right direction.

The laser printer 1 includes, in addition to the above image forming unit 3A and sheet feeding unit 3B, a cartridge holding section 3C, a remaining amount detecting device 9, and a control device 10 (FIG. 3).

As shown in FIGS. 1 and 2, the cartridge holding section 3C is a portion where the process cartridge 5 is detachably mounted or attached. The cartridge holding section 3C is formed inside the casing 2. According to the embodiment, the process cartridge 5 includes the drum cartridge 6 and the developing cartridge 7 mounted on the drum cartridge 6. Therefore, the cartridge holding section 3C is configured so that the developing cartridge 7L or 7H can be detachably mounted on or attached to the cartridge holding section 3C via the drum cartridge 6.

As shown in FIG. 3, the remaining amount detecting device 9 is a device that detects an amount of toner T remaining in the developing cartridge 7H (specifically, in the accommodating section 74H) attached to the cartridge holding section 3C. The remaining amount detecting device 9 includes a light emitting element 91 and a light receiving element 92. The light emitting element 91 and the light receiving element 92 are so disposed as to face each other. A pair of light transmission portions 78 of the developing cartridge 7H mounted in the cartridge holding section 3C is sandwiched between the light emitting element 91 and the light receiving element 92. The light emitting element 91 is an element that emits light (see chain line), via one of the light transmission portions 78, into the developing cartridge 7H attached to the cartridge holding section 3C. The light receiving element 92 is an element that receives the light via the other light transmission portion 78 after the light emitted from the light emitting element 91 passes inside the developing cartridge 7H. The light receiving element 92 outputs, to the control device 10, an output signal (output information) that varies according to the intensity of the received light.

When the accommodating section 74H is filled with toner, the light emitted from the light emitting element 91 is blocked by the toner. Therefore, the light receiving element 92 receives little light. However, as the toner is consumed as a result of formation of images on the sheets S, the amount of the toner in the accommodating section 74H becomes smaller, and the intensity of light received by the light receiving element 92 becomes gradually higher. The remaining amount detecting device 9 is configured to use such a change in the intensity of light received by the light receiving element 92 to detect the amount of toner T remaining in the developing cartridge 7H. The remaining amount detecting unit 9 is configured to detect a remaining amount of toner in a developer cartridge attached to the cartridge holding section 3C.

The control device 10 includes a CPU, RAM, ROM, and input/output interfaces, which are not shown in the diagrams. The control device 10 is so configured as to control operation of the laser printer 1 by controlling each part of the laser printer 1. More specifically, according to the embodiment, when an external device 100 (see FIG. 4), such as a personal computer or a digital camera, inputs a job containing print instructions and image data or data of an image that should be formed, the control device 10 controls the image forming unit 3A and the sheet feeding unit 3B to form an image on a sheet S. Moreover, according to the embodiment, the control device 10 is so configured as to determine the time to replace the developing cartridge 7 (7L, 7H) attached to the cartridge holding section 3C.

Figure 4:
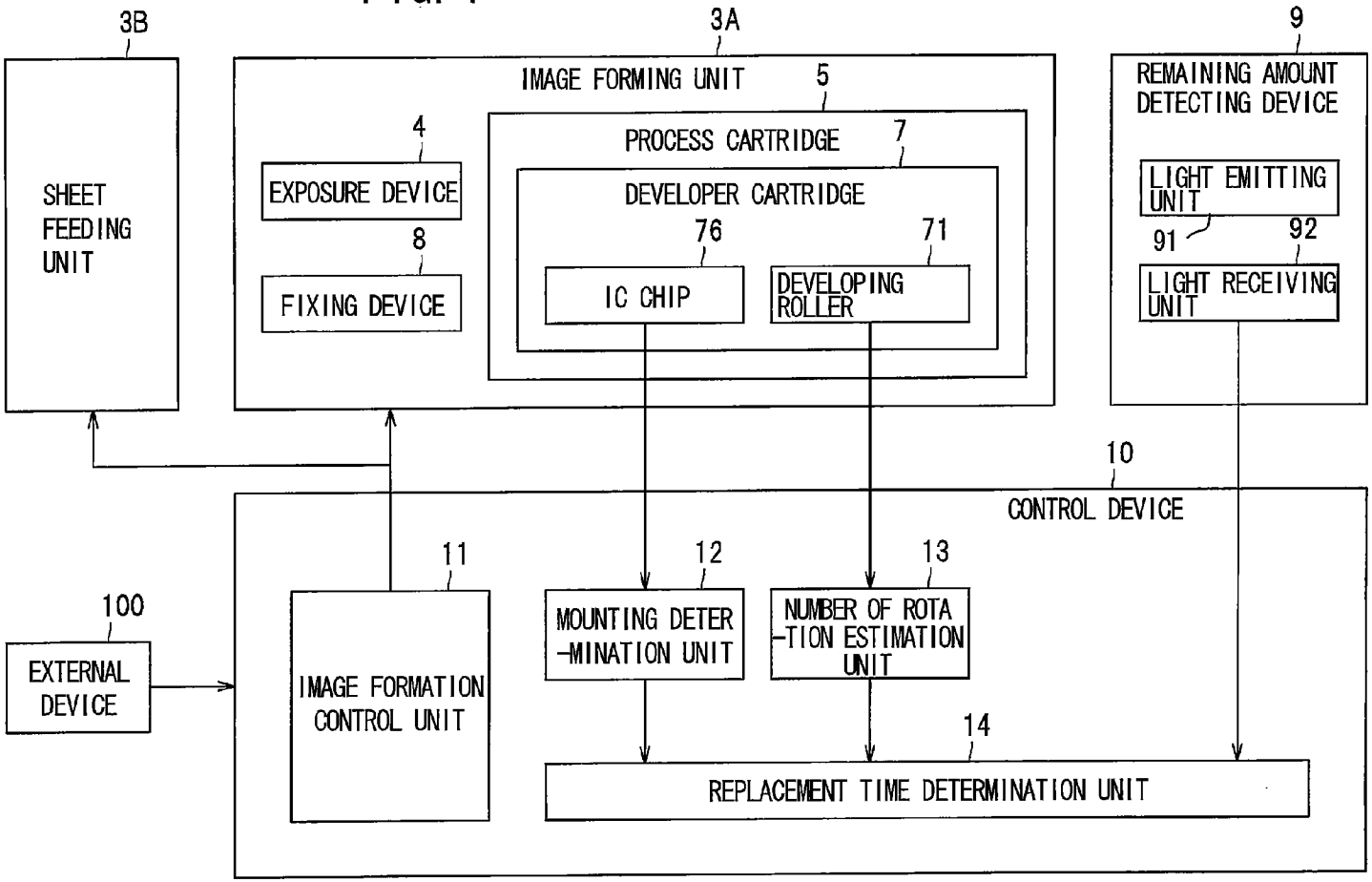
FIG. 4 is a block diagram showing the image forming device according to the embodiment.

In order to perform the above control process, as shown in FIG. 4, the control device 10 mainly includes, as functional units, an image formation control unit 11, a mounting determination unit 12, a number-of-rotations estimation unit 13, and a replacement time determination unit 14.

The image formation control unit 11 is a functional unit that controls the image forming unit 3A and the sheet feeding unit 3B when an image is formed on a sheet S. The image formation control unit 11 is so configured as not to perform the formation of an image on a sheet S even as a job is input from the external device 100, if the developing cartridge 7 is not attached to the cartridge holding section 3C or if it is determined that now is the time to replace the attached developing cartridge 7.

The mounting determination unit 12 is a functional unit that determines which developing cartridge, 7L or 7H, is mounted in or attached to the cartridge holding section 3C. Incidentally, according to the present invention, the way to determine which developing cartridge, 7L or 7H, is mounted is not limited to a specific method, or a configuration that realizes such a method. For example, as shown in FIG. 4, if the developing cartridge 7 includes an IC chip 76 in which specification information (or information about whether the developing cartridge 7 is of a small or large capacity type) is stored in advance, the mounting determination unit 12 may determine which developing cartridge, 7L or 7H, is mounted based on information input from a device that reads the information of the IC chip 76. Instead, as disclosed in Japanese Patent Application Laid-open Publication No. 2011-203493, if the developing cartridge 7 includes some kind of mechanical configuration such as a detection gear used to detect the specifications, the mounting determination unit 12 may determine which developing cartridge, 7L or 7H, is mounted based on information input from a sensor that detects the state of the detection gear.

The number-of-rotations estimation unit 13 is a functional unit that estimates the number of times the developing roller 71 (71L, 71H) of the developing cartridge 7 (7L, 7H) attached to the cartridge holding section 3C has been rotated. Incidentally, according to the present invention, the way to estimate the number of rotations of the developing roller 71 is not limited to a specific method, or a configuration that realizes such a method. For example, the number-of-rotations estimation unit 13 may acquire information from a sensor that counts the number of rotations of the developing roller 71; or may calculate the number of rotations of the developing roller 71 based on information about how long the developing roller 71 has been driven and the number of times the developing roller 71 has been rotated in a unit of time.

The replacement time determination unit 14 is a functional unit that determines the time to replace the developing cartridge 7 mounted in the cartridge holding section 3C. According to the embodiment, the replacement time determination unit 14 is so configured as to change how to determine the replacement time depending on the specifications of the developing cartridge 7 mounted in the cartridge holding section 3C, or on whether the small-capacity-type developing cartridge 7L or the large-capacity-type developing cartridge 7H is being mounted.

More specifically, as shown in FIG. 1, if the small-capacity-type developing cartridge 7L is mounted in the cartridge holding section 3C, the replacement time determination unit 14 estimates the amount of toner consumed based on image data that is input after the developing cartridge 7L is mounted. Then, the replacement time determination unit 14 determines whether or not the present time is time to replace the developing cartridge 7L based on the amount of toner consumed that is estimated. More specifically, according to the embodiment, the amount of toner consumed is an accumulated value of the numbers of dots of images that have been formed on the sheets S. For example, the accumulated value can be obtained by adding up the numbers of dots each time image data is input. The numbers of dots are based on information which is contained in the image data input from the external device 100 (see FIG. 4) and which is used to drive the laser light source (not shown) of the exposure device 4. Then, when the number-of-dots accumulated value ND exceeds a preset first threshold value Th1 relating to the numbers of dots, the replacement time determination unit 14 determines that now is the time to replace the developing cartridge 7L. Incidentally, according to the embodiment, the replacement time determination unit 14 is so configured as to reset the number-of-dots accumulated value after the developing cartridge 7 is replaced with a new one.

As shown in FIG. 2, if the large-capacity-type developing cartridge 7H is mounted in the cartridge holding section 3C, the replacement time determination unit 14 determines whether or not the present time is time that the developing cartridge 7H should be replaced based on information input from the light receiving element 92 (see FIG. 4) of the remaining amount detecting device 9. More specifically, first the replacement time determination unit 14 calculates an amount of toner remaining in the accommodating section 74H based on the information input from the light receiving element 92. When the calculated amount RT of remaining toner becomes smaller than a preset second threshold value Th2 relating to the amount of remaining toner, then the replacement time determination unit 14 determines that now is the time to replace the developing cartridge 7H.

According to the embodiment, when the replacement time determination unit 14 determines that it is the time to replace the developing cartridge 7 (7L or 7H), the replacement time determination unit 14 notifies a user of that fact. Incidentally, the way to notify a user of the replacement time is not limited to a specific method, or a configuration that realizes such a method. For example, a message indicating that replacement of developing cartridge is needed may be displayed on a display unit provided on the casing 2; or a replacement time notification lamp provided on the casing 2 may be turned ON; or a warning or a message may be output from a speaker provided on the casing 2; or a message indicating that it is time to replace the cartridge may be displayed on a display of the external device 100 such as a personal computer, for example.

Moreover, according to the embodiment, the replacement time determination unit 14 is so configured as to change the first threshold value Th1 and the second threshold value Th2 in such a way that it is more likely to be determined that the replacement time has come or that replacement of the attached cartridge is needed, in response to an increase in the number of rotations of the developing roller 71 estimated by the number-of-rotations estimation unit 13.

Figure 5A:
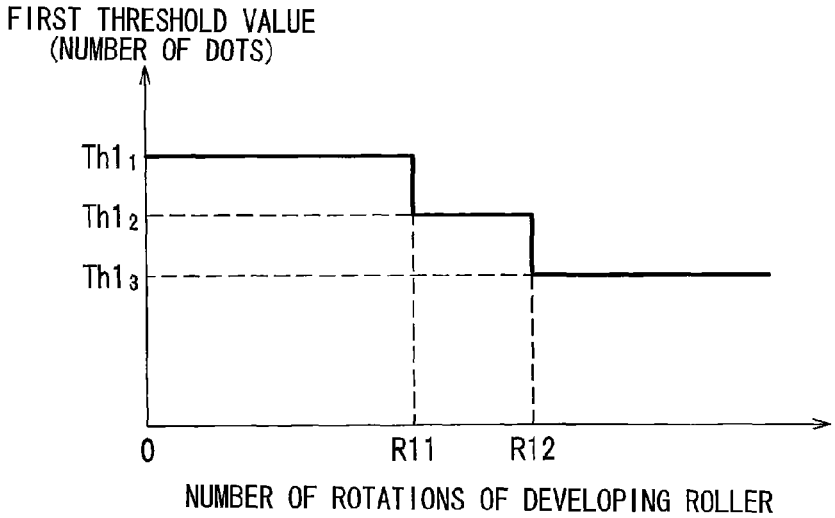
FIG. 5A is an explanatory diagram showing how to change a first threshold value.

More specifically, the first threshold value Th1 is a threshold value relating to the number of dots. The first threshold value Th1 is initially set to a predetermined value $Th1_1$ as shown in FIG. 5A. After the number of rotations of the developing roller 71L exceeds R11 (0<R11), the replacement time determination unit 14 sets the first threshold value to $Th1_2$, which is smaller than $Th1_1$. After the number of rotations of the developing roller 71L exceeds R12 (R11<R12), the replacement time determination unit 14 sets the first threshold value to $Th1_3$, which is smaller than $Th1_2$. In this manner, in response to an increase in the number of rotations of the developing roller 71L, the first threshold value becomes smaller, making the number-of-dots accumulated value ND more likely to exceed the first threshold value Th1. As a result, it is more likely to be determined that the time has come to replace the attached developing cartridge 7L.

Figure 5B:
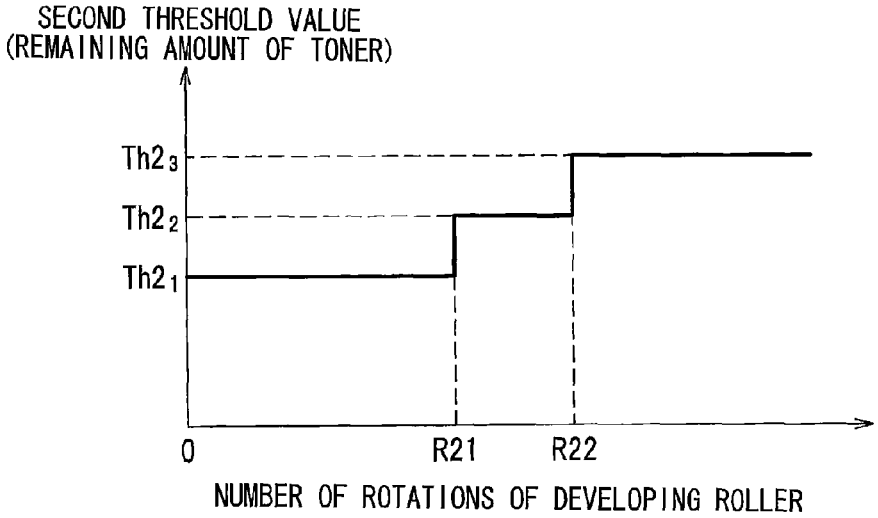
FIG. 5B is an explanatory diagram showing how to change a second threshold value.

The second threshold value Th2 is a threshold value relating to the amount of remaining toner. The second threshold value Th2 is initially set to $Th2_1$ as shown in FIG. 5B. After the number of rotations of the developing roller 71H exceeds R21 (0<R21), the replacement time determination unit 14 sets the second threshold value to $Th2_2$, which is greater than $Th2_1$. After the number of rotations of the developing roller 71H exceeds R22 (R21<R22), the replacement time determination unit 14 sets the second threshold value to $Th2_3$, which is greater than $Th2_2$. In this manner, in response to an increase in the number of rotations of the developing roller 71H, the second threshold value becomes greater, making the calculated amount RT of remaining toner more likely to go below the second threshold value Th2. As a result, it is more likely to be determined that the time has come to replace the mounted developing cartridge 7H. Incidentally, R21 may be equal to, or not equal to, R11. Similarly, R22 may be equal to, or not equal to, R12.

In the electrophotographic laser printer 1, an increase in the number of rotations of the developing roller 71L or 71H leads to deterioration of toner due to a decrease in charging performance of the toner that is caused by sliding contact of toner between the developing roller 71L or 71H and the supply roller 72 and layer thickness regulating blade 73 or by stirring of the agitator 75, possibly resulting in a drop in the quality of an image formed on a sheet S. According to the embodiment, as described above, in response to an increase in the number of rotations of the developing rollers 71L and 71H, the threshold values Th1 and Th2 are changed in such a way that it is more likely to be determined that the replacement time has come. As a result, the time to replace the developing cartridges 7L and 7H will arrive earlier; it can be determined that the time has come to replace the developing cartridges 7L and 7H before a decrease in the quality of the image actually takes place.

A process of controlling the above replacement time determination by the control device 10 of the developing cartridge 7 will be described with reference to a flowchart shown in FIG. 6. The control device 10 repeatedly performs the process of the flowchart shown in FIG. 6 at predetermined timing.

Figure 6:
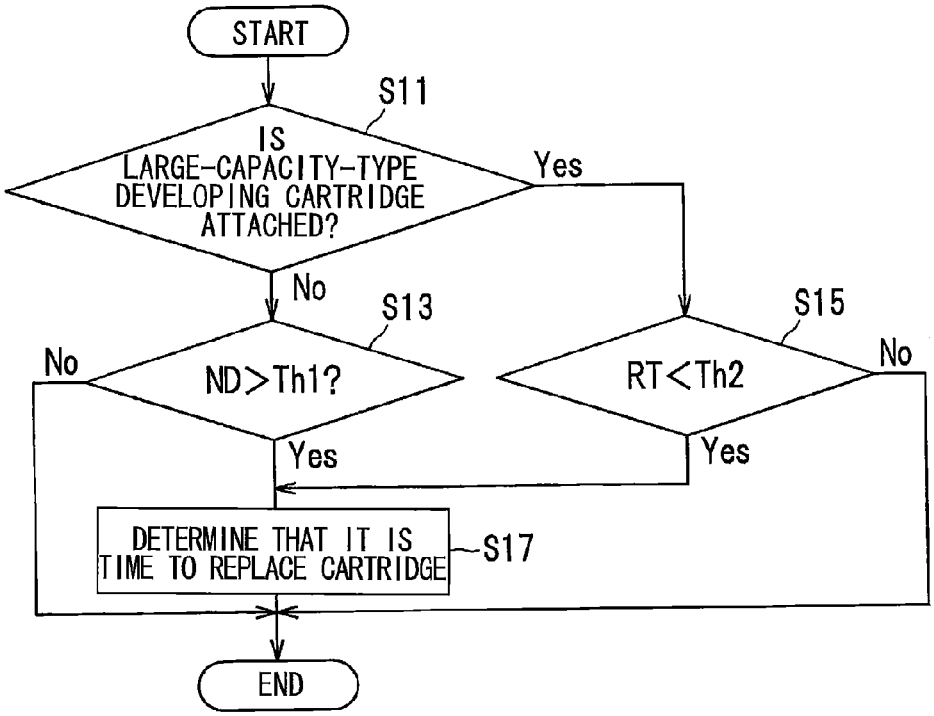
FIG. 6 is a flowchart illustrating steps in a process for determining the replacement time by the image forming device.

As shown in FIG. 6, after the start of the process of controlling the replacement time determination, the control device 10 determines which developing cartridge, the small-capacity-type developing cartridge 7L or the large-capacity-type developing cartridge 7H, is attached to the cartridge holding section 3C (S11). In other words, the control device 10 determines whether a cartridge attached to the cartridge holding section 3C is the small-capacity-type developing cartridge 7L or the large-capacity-type developing cartridge 7H.

If the small-capacity-type developing cartridge 7L is attached (S11: No), the control device 10 estimates the number-of-dots accumulated value ND and determines whether or not the number-of-dots accumulated value ND exceeds the first threshold value Th1 (S13). The number-of-dots accumulated value ND is based on image data that is input after the developing cartridge 7L is attached. If the number-of-dots accumulated value ND does not exceed the first threshold value Th1 (S13: No), the control device 10 ends the process of the flowchart shown in FIG. 6. If the number-of-dots accumulated value ND exceeds the first threshold value Th1 (S13: Yes), the control device 10 determines that the time has come to replace the currently attached developing cartridge 7L or that replacement of the developing cartridge 7L is needed (S17), and notifies a user of that fact before ending the process of the flowchart shown in FIG. 6.

If the large-capacity-type developing cartridge 7H is attached to the cartridge holding section 3C (S11: Yes), the control device 10 calculates the amount RT of remaining toner (as an example of detection value) based on detection signal or information input from the remaining amount detecting device 9, and then determines whether or not the calculated amount RT of remaining toner is less than the second threshold value Th2 (S15). If the amount RT of remaining toner is not less than the second threshold value Th2 (S15: No), the control device 10 ends the process of the flowchart shown in FIG. 6. If the amount RT of remaining toner is less than the second threshold value Th2 (S15: Yes), the control device 10 determines that the time has come to replace the currently mounted developing cartridge 7H or that replacement of the developing cartridge 7H is needed (S17), and then notifies a user of that fact before ending the process of the flowchart shown in FIG. 6.

The above-described image forming system and laser printer 1 according to the embodiment determine the replacement time by using the number-of-dots accumulated value when the developing cartridge 7L with a small initial accommodated amount of toner is attached to the laser printer 1. When the developing cartridge 7H with a large initial accommodated amount of toner is attached to the laser printer 1, the image forming system and the laser printer 1 do not use the number-of-dots accumulated value that is likely to have a larger error, and instead use the remaining amount detecting device 9 in determining that replacement of the developing cartridge 7H is needed. Therefore, the image forming system and the laser printer 1 can appropriately determine the time to replace the developing cartridges 7L and 7H with different initial amounts of toner filling the cartridges.

Moreover, according to the embodiment, for the small-capacity-type developing cartridge 7L, the remaining amount detecting device 9 is not used to determine whether or not the present time is the replacement time. Therefore, there is no need to provide a plurality of remaining amount detection devices 9 (light emitting elements 91 and light receiving elements 92) for each of the developing cartridges 7L and 7H. As a result, the configuration of the laser printer 1 is simplified, resulting in a drop in the costs of the laser printer 1.

Furthermore, according to the embodiment, for the large-capacity-type developing cartridge 7H, the remaining amount detecting device 9 is used to determine the replacement time. Therefore, the initial amount of toner filling the cartridge can be made appropriate. That is, the quality of images will inevitably decrease due to a blur or the like as the amount of toner remaining in the developing cartridge goes below a certain level. Therefore, the developing cartridge is filled with an amount of toner slightly larger than needed, thereby avoiding a drop in the quality of images.

However, in the case of a large-capacity-type developing cartridge that is likely to have a larger error between the calculated amount of toner consumed and the actual amount of toner consumed, the developing cartridge may need to be filled with an even larger amount of toner in order to reduce the larger error. According to the embodiment, for the large-capacity-type developing cartridge 7H, the number-of-dots accumulated value is not used to determine the replacement time. Therefore, there is no need to fill the developing cartridge 7H with a still larger amount of toner. Thus, the initial amount of toner filling the cartridge can be made appropriate.

While the invention has been described in detail with reference to the embodiment thereof, it would be apparent to those skilled in the art that various changes and modifications may be made therein without departing from the spirit of the invention.

According to the above embodiment, if the large-capacity-type developing cartridge 7H is attached, the control device 10 (replacement time determination unit 14) calculates the amount RT of remaining toner based on information from the remaining amount detecting device 9, and determines that it is the replacement time by comparing the calculated amount RT of remaining toner with the threshold value relating to the amount of remaining toner. However, the present invention is not limited to that configuration. In other words, the control device of the present invention may not calculate the amount of remaining developer, and may determine the replacement time just based on the output signal of the light receiving element 92. For example, the control device may calculate a percentage of the time during which the light receiving element 92 receives light whose intensity is greater than or equal to a predetermined level within a predetermined period of time; if the calculated percentage exceeds a threshold value relating to the percentage of the time, the control device may determine that the replacement time has come. Alternatively, if the intensity of the light received by the light receiving element 92 exceeds a threshold value relating to the intensity of the light, the control device may determine that the replacement time has come.

According to the above embodiment, the remaining amount detecting device 9 includes the light emitting element 91 and the light receiving element 92 and makes use of a change in the intensity of the light received by the light receiving element 92 to detect the amount of toner remaining in the developing cartridge 7H. However, the present invention is not limited to that configuration. For example, the remaining amount detection device may be a device that has a pair of electrodes which are so disposed as to face each other within the cartridge; the device may make use of a change in the capacitance between the electrodes caused by a decrease in the amount of toner between the electrodes to detect the amount of toner remaining in the cartridge. Alternatively, the remaining amount detection device may be a device that measures the weight of the cartridge to detect the amount of toner remaining in the cartridge.

According to the above embodiment, as shown in FIGS. 5A and 5B, the control device 10 changes the threshold values Th1 and Th2 twice in stages in response to an increase in the number of rotations of the developing rollers 71L and 71H. However, the present invention is not limited to that configuration. The number of times the threshold values are changed may be one, or three or more. Moreover, the threshold values may not be changed in stages. For example, as a function of the number of rotations of the developing rollers, the threshold values may be continuously changed. Furthermore, in the case of the present invention, at least either the first or the second threshold value may not be changed in response to an increase in the number of rotations of the developing rollers.

According to the above embodiment, as a developer cartridge, the developing cartridge 7 having the developing roller 71 and the accommodating section 74 is illustrated. However, the present invention is not limited to that configuration. For example, the developer cartridge may be a toner box that does not include a developing roller and mainly includes an accommodating section in which toner is stored. Alternatively, the developer cartridge may be a process cartridge that includes not only a developing roller and a storage section but also a photoconductive drum.

The configuration of the image forming unit 3A illustrated in the above embodiment is one example. The present invention is not limited to the above configuration. In the above embodiment, the laser printer 1 includes the exposure device 4 that is so configured as to emit a laser beam to expose the photosensitive drum 61. However, the present invention is not limited to that configuration. An exposure device that is so configured as to use a light emitting diode to expose the photoconductive drum may be employed. Moreover, in the above embodiment, the fixing device 8 is so configured as to thermally fix a toner image on a sheet S between the heating roller 81 and the pressure roller 82. However, the present invention is not limited to that configuration. For example, a fixing device of a belt-fixing type may be employed.

According to the above embodiment, the laser printer 1 is configured to form only monochrome images. However, the present invention is not limited to that laser printer. For example, the image forming device may be a printer that can form color images. Moreover, the image forming device is not limited to the printers. For example, the image forming device may be a copy or multifunctional machine that includes a document reading device such as a flat head scanner.

What is claimed is:

1. An image forming device comprising:

an image forming unit configured to form an image on a sheet based on image data;

a holding section to which either a first developer cartridge or a second developer cartridge is attachable, each of the first developer cartridge and the second developer cartridge being configured to accommodate developer therein, the second developer cartridge having capacity for accommodating developer larger than capacity for accommodating developer of the first developer cartridge;

a detection device configured to detect a remaining amount of developer in a developer cartridge attached to the holding section and configured to output detection information; and a control device configured to control the image forming unit to form the image on the sheet when the image data is inputted, wherein the control device is further configured to:

determine whether the developer cartridge attached to the holding section is the first developer cartridge or the second developer cartridge;

determine that replacement of the developer cartridge attached to the holding section is needed upon comparison of a consumed amount of developer based on the image data that is inputted with a first prescribed threshold value when the developer cartridge attached to the holding section is determined to be the first developer cartridge; and determine that replacement of the developer cartridge attached to the holding section is needed upon comparison of a detection value with a second prescribed threshold value when the developer cartridge attached to the holding section is determined to be the second developer cartridge, the detection value being based on the detection information outputted by the detection device.

2. The image forming device according to claim 1, wherein when the developer cartridge attached to the holding section is determined to be the first developer cartridge and the consumed amount of developer is greater than the first prescribed threshold value, the control device determines that replacement of the developer cartridge attached to the holding section is needed;

wherein when the developer cartridge attached to the holding section is determined to be the second developer cartridge and the detection value is smaller than the second prescribed threshold value, the control device determines that replacement of the developer cartridge attached to the holding section is needed.

3. The image forming device according to claim 1, wherein when the developer cartridge attached to the holding section is determined to be the first developer cartridge and the consumed amount of developer exceeds the first prescribed threshold value, the control device determines that replacement of the developer cartridge attached to the holding section is needed;

wherein when the developer cartridge attached to the holding section is determined to be the second developer cartridge and the detection value exceeds the second prescribed threshold value, the control device determines that replacement of the developer cartridge attached to the holding section is needed.

4. The image forming device according to claim 1, wherein the detection device includes:

a light emitting element configured to emit light into the developer cartridge attached to the holding section; and a light receiving element configured to receive the light that has emitted by the light emitting element and passes through the developer cartridge attached to the holding section.

5. The image forming device according to claim 1, wherein the consumed amount of developer is an accumulated value of a number of dots included in images that the image forming unit have formed.

6. The image forming device according to claim 1, wherein the first developer cartridge and the second developer cartridge include a first developing roller and a second developing roller, respectively;

wherein the control device is further configured to:

estimate a rotation number of the first developing roller when the first developer cartridge is attached to the holding section;

estimate a rotation number of the second developing roller when the second developer cartridge is attached to the holding section;

change, in response to an increase in the rotation number of the first developing roller that is estimated, the first prescribed threshold value to a third prescribed threshold value such that it is more likely to be determined that replacement of the first cartridge attached to the holding section is needed; and change, in response to an increase in the rotation number of the second developing roller that is estimated, the second prescribed threshold value to a fourth prescribed threshold value such that it is more likely to be determined that replacement of the second cartridge attached to the holding section is needed.

7. An image forming system comprising:

a first developer cartridge configured to accommodate developer therein;

a second developer cartridge configured to accommodate developer therein, the second developer cartridge having capacity for accommodating developer larger than capacity for accommodating developer of the first developer cartridge; and an image forming device comprising:

an image forming unit configured to form an image on a sheet based on image data;

a holding section to which either the first developer cartridge or the second developer cartridge is attachable;

a detection device configured to detect a remaining amount of developer in a developer cartridge attached to the holding section and configured to output detection information; and a control device configured to control the image forming unit to form the image on the sheet when the image data is inputted, wherein the control device is further configured to:

determine whether the developer cartridge attached to the holding section is the first developer cartridge or the second developer cartridge;

determine that replacement of the developer cartridge attached to the holding section is needed upon comparison of a consumed amount of developer based on the image data that is inputted with a first prescribed threshold value when the developer cartridge attached to the holding section is determined to be the first developer cartridge; and determine that replacement of the developer cartridge attached to the holding section is needed upon comparison of a detection value with a second prescribed threshold value when the developer cartridge attached to the holding section is determined to be the second developer cartridge, the detection value being based on the detection information outputted by the detection device.

* * * * *